US011022275B2

(12) United States Patent
Chau

(10) Patent No.: US 11,022,275 B2
(45) Date of Patent: Jun. 1, 2021

(54) OPTICAL DEVICE AND ILLUMINATION DEVICE

(71) Applicant: Chi-Yuen Chau, Taichung (TW)

(72) Inventor: Chi-Yuen Chau, Taichung (TW)

( * ) Notice: Subject to any disclaimer, the term of this patent is extended or adjusted under 35 U.S.C. 154(b) by 0 days.

(21) Appl. No.: 16/820,716

(22) Filed: Mar. 17, 2020

(65) Prior Publication Data

US 2020/0300443 A1 Sep. 24, 2020

Related U.S. Application Data

(60) Provisional application No. 62/819,686, filed on Mar. 18, 2019.

(51) Int. Cl.

| | |
|---|---|
| ***F21V 7/00*** | (2006.01) |
| ***F21V 7/04*** | (2006.01) |
| *F21Y 115/10* | (2016.01) |

(52) U.S. Cl.

CPC ..... *F21V 7/0025* (2013.01); *F21V 7/045* (2013.01); *F21Y 2115/10* (2016.08)

(58) Field of Classification Search

None

See application file for complete search history.

(56) References Cited

FOREIGN PATENT DOCUMENTS

| | | |
|---|---|---|
| CN | 103365033 | 10/2013 |
| CN | 204403830 | 6/2015 |
| WO | 2017/035113 | 3/2017 |

OTHER PUBLICATIONS

"Office Action of Taiwan Counterpart Application", dated Aug. 7, 2020, p. 1-p. 7.

*Primary Examiner* — Vip Patel
(74) *Attorney, Agent, or Firm* — JCIPRNET

(57) ABSTRACT

An optical device including a conductive chamber, a first optical module, a second optical module, and a third optical module is provided. The conductive chamber has a light-entrance end. The first optical module, the second optical module, and the third optical module are fixed in the conductive chamber, where the first optical module is adjacent to the light-entrance end and located between the light-entrance end and the second optical module, and the second optical module is located between the first optical module and the third optical module. The conductive chamber, the first optical module, and the second optical module together define a first resonant space. The conductive chamber, the second optical module, and the third optical module together define a second resonant space. An illumination device is also provided.

10 Claims, 2 Drawing Sheets

OPTICAL DEVICE AND ILLUMINATION DEVICE

CROSS-REFERENCE TO RELATED APPLICATION

This application claims the priority benefit of U.S. provisional application Ser. No. 62/819,686, filed on Mar. 18, 2019. The entirety of the above-mentioned patent application is hereby incorporated by reference herein and made a part of this specification.

BACKGROUND

Technical Field

The disclosure relates to an electronic device, and more particularly, to an optical device and an illumination device.

Description of Related Art

Currently, most illumination devices adopt a reflection method to project the beam emitted by the light source to the outside of the illumination device to thereby increase the brightness of illumination, the distance of light projection, or the range of illumination. However, since most light sources have large divergence angles, as the light projection distance increases, the light source energy density received per unit area of the illuminated object will significantly decrease. To address the above issue, the related art mainly uses a light source with a higher power to satisfy the illumination requirements, but this approach will consume more energy.

SUMMARY

The disclosure provides an optical device which contributes to amplifying the energy of the output light.

The disclosure provides an illumination device which can satisfy the illumination requirements without consuming more energy.

An optical device of the disclosure includes a conductive chamber, a first optical module, a second optical module, and a third optical module. The conductive chamber has a light-entrance end. The first optical module is fixed in the conductive chamber and is adjacent to the light-entrance end. The second optical module is fixed in the conductive chamber. The first optical module is located between the light-entrance end and the second optical module. The conductive chamber, the first optical module, and the second optical module together define a first resonant space. The third optical module is fixed in the conductive chamber. The second optical module is located between the first optical module and the third optical module. The conductive chamber, the second optical module, and the third optical module together define a second resonant space.

In an embodiment of the disclosure, a material of the conductive chamber includes a conductive material.

In an embodiment of the disclosure, the light-entrance end of the conductive chamber has a light source receiving hole configured to receive a light source.

In an embodiment of the disclosure, the first optical module is a light focusing module.

In an embodiment of the disclosure, any one of the second optical module and the third optical module includes an optical element which allows a portion of a beam to pass through and reflects another portion of the beam.

In an embodiment of the disclosure, the third optical module is a lens or a protective cover.

In an embodiment of the disclosure, an edge of the first optical module, an edge of the second optical module, and an edge of the third optical module are all fixed on a sidewall of the conductive chamber.

In an embodiment of the disclosure, materials of the first optical module, the second optical module, and the third optical module are glass or plastic.

In an embodiment of the disclosure, a refractive index of a light transmitting medium in the first resonant space and the second resonant space is 1.

An illumination device of the disclosure includes a light source and an optical device. The light source is adapted to output a beam. The optical device is disposed on a transmission path of the beam and includes a conductive chamber, a first optical module, and a second optical module. The conductive chamber has a light-entrance end. The light source is disposed at the light-entrance end. The first optical module is fixed in the conductive chamber and is adjacent to the light-entrance end. The second optical module is fixed in the conductive chamber. The first optical module is located between the light-entrance end and the second optical module. The conductive chamber, the first optical module, and the second optical module together define a first resonant space.

Based on the above, in the optical device of the embodiment of the disclosure, the beam is amplified by resonance through one or more resonant spaces. Therefore, the optical device of the embodiment of the disclosure contributes to amplifying the energy of the output light. In addition, with the one or more resonant spaces provided, the illumination device of the embodiment of the disclosure can satisfy the illumination requirements without consuming more energy.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1:
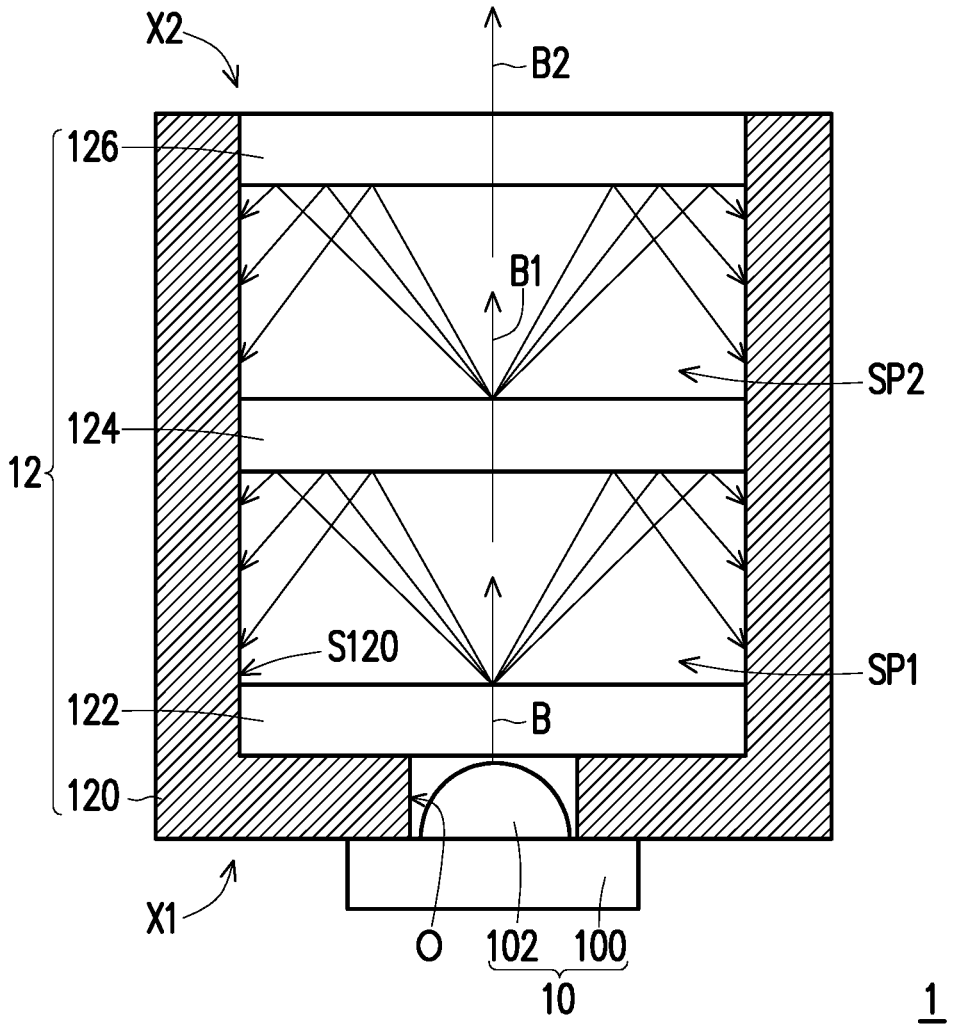
FIG. 1 is a schematic cross-sectional view showing an illumination device according to an embodiment of the disclosure.

The directional terminology (e.g., "above", "below", "front", "back", "left", and "right") mentioned in the embodiments only refers to the directions of the accompanying drawings. Therefore, the directional terminology as used is intended to illustrate, rather than limit, the disclosure. In the drawings, the figures show typical features of the methods, structures, and/or materials used in the particular exemplary embodiments. However, the drawings are not to be interpreted as defining or limiting the scope or nature of the exemplary embodiments. For example, for clarity, the relative size, thickness, and location of the various layers, regions, and/or structures may be reduced or magnified.

In the exemplary embodiments provided herein, the same or similar elements will be given the same or similar reference numerals and their description will be omitted. In addition, the features in the different exemplary embodiments may be combined with each other as long as there is no conflict, and simple equivalent changes and modifications made according to the specification or claims are still within the scope of this disclosure. Moreover, "first", "second", and similar terms mentioned in the specification or the claims are merely used to name the discrete elements or to differentiate among different embodiments or ranges. Therefore, the terms should not be regarded as limiting the upper or lower bound of the number of the elements and should not be used to limit the manufacturing sequence or arrangement sequence of the elements.

FIG. 1 is a schematic cross-sectional view showing an illumination device 1 according to an embodiment of the disclosure. Referring to FIG. 1, the illumination device 1 includes a light source 10 and an optical device 12.

The light source 10 is adapted to output a beam B. The light source 10 may be a light-emitting diode light source, a laser light source, or a combination of the two. Taking the light-emitting diode light source as an example, the light source 10 may include a circuit board 100 and at least one light-emitting diode 102. The circuit board 100 may be a printed circuit board (PCB), a flexible printed circuit (FPC), or any other substrate suitable for carrying circuits.

When the illumination device 1 is used for general illumination, the light-emitting diode 102 may be a white light-emitting diode. Alternatively, the light-emitting diode 102 may be a blue light-emitting diode with at least one color conversion layer (not shown). The color conversion layer is adapted to absorb short-wavelength beams (e.g., blue light) and emit long-wavelength beams (e.g., yellow, red, or green light). For example, the material of the color conversion layer may include phosphor, quantum dots, or a combination of the two.

The color conversion layer may cover the light-emitting diode 102 so that the light-emitting diode 102 is located between the color conversion layer and the circuit board 100. When the light source 10 includes multiple light-emitting diodes 102, the multiple light-emitting diodes 102 may share the same one color conversion layer. Alternatively, it is also possible that the multiple light-emitting diodes 102 do not share the same one color conversion layer. For example, the multiple light-emitting diodes 102 may be respectively covered with multiple color conversion layers. The multiple color conversion layers are structurally separated and may be excited to emit beams of the same color or different colors. For example, the multiple color conversion layers may be respectively excited to emit red light, green light, and blue light to mix and form white light. In other words, the color of the beam B is white. However, the color of the beam B may be changed according to different requirements, and the specific architecture of the light-emitting diode 102 may be adjusted according to the required color of the beam B.

In the architecture provided with a color conversion layer, the shape of the color conversion layer may be hemispherical to provide a light converging effect, but the disclosure is not limited thereto. In an embodiment, a protective layer may be further provided on the color conversion layer to isolate the negative effects of air and moisture on the color conversion layer. In the architecture provided with a protective layer, the shape of the protective layer may be hemispherical to provide a light converging effect, so that the shape of the color conversion layer may or may not be hemispherical. In addition, in the architecture without a color conversion layer, a hemispherical protective layer may also be provided on the light-emitting diode 102 to provide a light converging effect.

The optical device 12 is disposed on the transmission path of the beam B and is adapted to amplify the energy of the emitted light and adjust the light pattern of the emitted light. Specifically, the optical device 12 includes a conductive chamber 120, a first optical module 122, a second optical module 124, and a third optical module 126.

The conductive chamber 120 is adapted to fix the light source 10, the first optical module 122, the second optical module 124, and the third optical module 126. The conductive chamber 120 may be an integrally formed single-piece structure, or may be a multi-piece structure formed by assembling multiple pieces, and the multiple pieces may have the same or different materials. In addition to being adapted to fix the light source 10, the first optical module 122, the second optical module 124, and the third optical module 126, the conductive chamber 120 may also serve as an object which receives photons and emits electrons in the photoelectric effect. Therefore, the material of the conductive chamber 120 includes a conductive material suitable for generating the photoelectric effect and is exemplarily a material having good conductivity. For example, the material of the conductive chamber 120 may include metal, alloy, graphene, or a combination of at least two of the above, but the disclosure is not limited thereto.

The conductive chamber 120 has a light-entrance end X1 and a light-exit end X2 opposite to the light-entrance end X1. The light source 10 is disposed at the light-entrance end X1, so that the beam B output by the light source 10 enters the conductive chamber 120 via the light-entrance end X1, and the beam B is output from the conductive chamber 120 via the light-exit end X2.

In this embodiment, the light-entrance end X1 of the conductive chamber 120 has a light source receiving hole O configured to receive a light source (e.g., the one or multiple light-emitting diodes 102), and the light-emitting diode 102 is disposed in the light source receiving hole O. However, the relative arrangement relationship between the conductive chamber 120 and the light source 10 is not limited thereto. For example, the light source 10 may be disposed entirely in the light source receiving hole O, but the disclosure is not limited thereto.

It is noted that the design parameters of the conductive chamber 120 (e.g., the shape and/or size of the conductive chamber 120, the shape and/or size of the light source receiving hole O, etc.) may be adjusted according to the requirements and are not limited to those shown in FIG. 1.

The first optical module 122, the second optical module 124, and the third optical module 126 are fixed in the conductive chamber 120. FIG. 1 schematically shows that the edge of the first optical module 122, the edge of the second optical module 124, and the edge of the third optical module 126 are all fixed on a sidewall S120 of the conductive chamber 120. However, the fixing method and/or the relative configuration relationship between the optical modules and the conductive chamber are not limited thereto. For example, the first optical module 122, the second optical module 124, and the third optical module 126 may be fixed in the conductive chamber 120 by engagement, locking, adhesion, or other suitable methods. When the conductive chamber 120 is formed by assembling multiple pieces, the multiple optical modules may be fixed between two adjacent pieces by engagement, locking, adhesion, or other suitable methods.

The first optical module 122 is adjacent to the light-entrance end X1 and is located between the light-entrance end X1 and the second optical module 124. The second optical module 124 is located between the first optical module 122 and the third optical module 126. The conductive chamber 120, the first optical module 122, and the second optical module 124 together define a first resonant space SP1. The conductive chamber 120, the second optical module 124, and the third optical module 126 together define a second resonant space SP2. In this embodiment, the refractive index of the light-transmitting medium in the first resonant space SP1 and the second resonant space SP2 is 1. In other words, the light-transmitting medium in the first resonant space SP1 and the second resonant space SP2 may be air, and it is possible that a filling material is not provided in the first resonant space SP1 and the second resonant space SP2. In some embodiments, the distance between the first resonant space SP1 and the second resonant space SP2 or their positions may be adjusted according to the requirements. Furthermore, the number of resonant spaces may also be increased or decreased according to the requirements.

The beam B output by the light source 10 enters the first resonant space SP1 via the first optical module 122. The first optical module 122 may be a light focusing module to converge the beam B output by the light source 10 into the first resonant space SP1. The light focusing module may include one or more lenses. Each of the one or more lenses may be a spherical or aspherical lens. In addition, the material of each of the one or more lenses may be glass or plastic.

Any one of the second optical module 124 and the third optical module 126 includes an optical element which allows a portion of the beam to pass through and reflects another portion of the beam. The optical element may be one or more lenses or a protective cover. Specifically, the components of the second optical module 124 and the third optical module 126 may be selected according to the actual requirements (e.g., the application scope), and the component type and/or quantity of the second optical module 124 may be the same or different from the component type and/or quantity of the third optical module 126. For example, the second optical module 124 may be a light focusing module including one or more lenses. When the third optical module 126 is used to increase the distance of light projection, the third optical module 126 may be a light focusing module including one or more lenses. On the other hand, when the third optical module 126 is used to increase the range of illumination, the third optical module 126 may be a light expanding module including one or more lenses, and the diopter of the light expanding module may be negative. Moreover, the third optical module 126 may also be a protective cover to protect the components located below it. The material of the protective cover may be glass or plastic. In addition, the protective cover may be a flat or curved substrate.

A portion of the beam B entering the first resonant space SP1 (a first portion for short) is output from the first resonant space SP1 to the second resonant space SP2 via the second optical module 124. Another portion of the beam B entering the first resonant space SP1 (a second portion for short) may be amplified by resonance through the first resonant space SP1 and output from the first resonant space SP1 to the second resonant space SP2 via the second optical module 124 after accumulating sufficient energy.

The first portion may be, for example, 60% of the beam B entering the first resonant space SP1, and the second portion may be, for example, 40% of the beam B entering the first resonant space SP1. However, the respective percentages of the first portion and the second portion may be changed according to different design requirements, and, by adjusting the design parameters (e.g., the curvature, refractive index, distance from other components, etc.) of the first optical module 122 and the second optical module 124, the respective percentages of the first portion and the second portion can be changed. For example, by adjusting the design parameters of the first optical module 122, the light energy distribution of the beam B transmitted to different regions (e.g. the central region and the peripheral region) of the second optical module 124 can be controlled. In addition, by adjusting the design parameters of the second optical module 124, the percentage of the first portion (the beam which directly passes through the second optical module 124) and the percentage of the second portion (the beam which is reflected by the second optical module 124) can be controlled.

In the first resonant space SP1, the second portion is reflected by the second optical module 124 to the sidewall S120 of the conductive chamber 120. The sidewall S120 converts photons into electrons based on the photoelectric effect. The electrons eventually release energy in the form of visible light, which thus generates a flash. Through the design of the first optical module 122, the second optical module 124, and the conductive chamber 120, the beam B (photons) can be reflected/impacted/collided back and forth multiple times in the first resonant space SP1 to excite more electrons to escape from the original orbit, thereby achieving a light energy amplification effect similar to that of a laser resonance cavity, such that the energy of a beam B1 output from the first resonant space SP1 exceeds the energy of the beam B entering the first resonant space SP1. In order to achieve the effect of resonance amplification, the frequency and phase of the beam B emitted by the light source 10 are adjusted to be the same or mostly the same as much as possible (i.e., to achieve coherence characteristics).

Similarly, a portion of the beam B1 entering the second resonant space SP2 via the second optical module 124 (a third portion for short) is output from the second resonant space SP2 to the outside of the optical device 12 via the third optical module 126. Another portion of the beam B1 entering the second resonant space SP2 (a fourth portion for short) may be amplified by resonance through the second resonant space SP2 and output from the second resonant space SP2 to the outside of the optical device 12 via the third optical module 126 after accumulating sufficient energy, such that the energy of a beam B2 output from the second resonant space SP2 exceeds the energy of the beam B1 entering the second resonant space SP2. Thereby, the energy of the beam B2 output from the optical device 12 can exceed the energy of the beam B output by the light source 10.

The third portion may be, for example, 60% of the beam B1 entering the second resonant space SP2, and the fourth portion may be, for example, 40% of the beam B1 entering the second resonant space SP2. However, the respective percentages of the third portion and the fourth portion may be changed according to different design requirements, and, by adjusting the design parameters (e.g., the curvature, refractive index, distance from other components, etc.) of the second optical module 124 and the third optical module 126, the respective percentages of the third portion and the fourth portion can be changed. Reference may be made to the foregoing for relevant descriptions, which will not be repeated herein.

Figure 2:
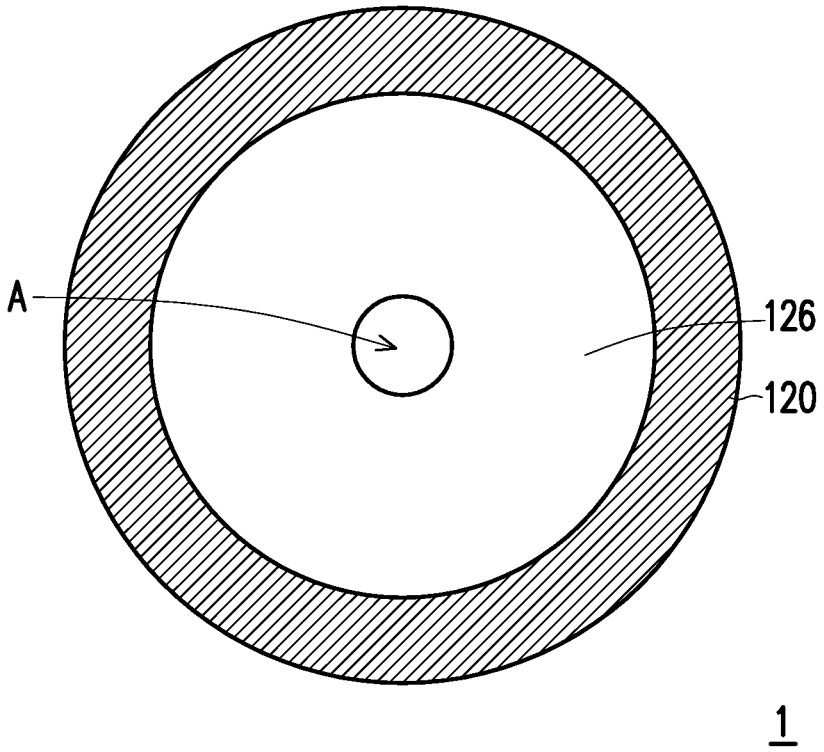
FIG. 2 is a schematic top view showing an illumination device according to an embodiment of the disclosure.

FIG. 2 is a schematic top view showing an illumination device 1 according to an embodiment of the disclosure. In FIG. 2, a region A of the third optical module 126 indicates that 60% of the beam passes through this region, but the percentage of the output beam of the region A is not limited thereto. In another embodiment, the percentage of the output beam of the region A may be 1% to 99%.

It is noted that, although it is schematically shown in the illumination device 1 in FIG. 1 that the optical device 12 has two resonant spaces, the number of the resonant spaces provided in the optical device is not limited thereto. Since each resonant space contributes to amplifying the energy of the emitted light, the optical device may have only one resonant space (e.g., the first resonant space). In such an architecture, the optical device does not include the third optical module 126, which reduces the overall volume of the optical device. In still another embodiment, the optical device may also have three or more resonant spaces. In such an architecture, the optical device may include more optical modules, so that each resonant space is collectively defined by two adjacent optical modules and the conductive chamber 120. Accordingly, the distance of light projection or the range of irradiation can be increased.

In addition, according to the requirements of different optical designs, lenses of different shapes may be adopted. Therefore, the shape of all optical modules is not limited to a specific shape, but may be circular, square, rectangular, oval, convex on one side, convex on both sides, convex-concave, textured on one side (e.g., pit texture) and untextured on the other side, textured on both sides, planar, planar on one side and curved on the other side, triangular, polygonal, or other shapes. In some embodiments, in addition to glass and plastic, the material of the optical module may also include a transparent or translucent polymer, or the optical module may even be formed from a liquid. In some embodiments, part of the optical materials may be added and formed with various different ore elements or color materials according to the requirements to thereby produce illumination devices having optical outputs of different colors. In other words, it is possible to add different minerals or color materials when manufacturing the optical lens and change the color of the output light using the different minerals or color materials in the optical lens, without the need to mix lights through light-emitting elements of different colors. In some embodiments, according to different uses and designs, a lens of a specific shape may be added to or a lens of a specific shape may be omitted from between the optical modules. It may even suffice to provide only a set of optical lenses to directly work with a metal resonant chamber. However, it may also be necessary to add a considerable number of optical modules or lenses, or increase or decrease their numbers in the original design according to the requirements. For example, the design of the optical module may also be modified or augmented with reference to some principles of a telescope.

Furthermore, the resonant space may be formed in different shapes, or a specific type of component may be additionally provided, such as a metal light mask or a reflective spare part. The spare part may be made of different materials such as metal, ceramic, plastic, graphene, or various ore elements. The optical module may be made of a general glass, may be an optical lens formulated according to a special formula, may be made of a plastic material (e.g., a PC material), or may be made of ceramic, quartz, or more advanced materials. The lens, height, width, or thickness adopted for the optical modules may all be different, but the disclosure is not limited thereto.

In some embodiments, the illumination device may have a wireless charging function. In some embodiments, the illumination device may have a central remote control system. In some embodiments, the illumination device may be controlled or monitored through the 5G network to save energy. In some embodiments, the illumination device may be charged or powered through solar energy or wireless transmission.

In summary of the above, in the optical device of the embodiment of the disclosure, based on the principle of quantum optics, the output power of the light-emitting diode light source is first amplified and enhanced through the resonant space to a higher energy level, so that the electrons collide with the photons, and each collision can produce more energy. Therefore, the optical device in the embodiment of the disclosure contributes to amplifying the energy of the output light. In addition, with the one or more resonant spaces provided, the illumination device of the embodiment of the disclosure can satisfy the illumination requirements (e.g., increasing the brightness of illumination, the distance of light projection, the range of illumination, etc.) without consuming more energy (without increasing the output power of the light-emitting diode light source), or the width and distance of the light source may be adjusted through precise optical designs to satisfy the requirements of the user. In addition, since the phase and frequency of the beam output from the illumination device are the same or mostly the same, the light intensity of the beam output from the illumination device can be more uniform.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. An optical device comprising:

a conductive chamber having a light-entrance end;

a first optical module fixed in the conductive chamber and adjacent to the light-entrance end;

a second optical module fixed in the conductive chamber, wherein the first optical module is located between the light-entrance end and the second optical module, and the conductive chamber, the first optical module, and the second optical module together define a first resonant space; and a third optical module fixed in the conductive chamber, wherein the second optical module is located between the first optical module and the third optical module, and the conductive chamber, the second optical module, and the third optical module together define a second resonant space.

2. The optical device according to claim 1, wherein a material of the conductive chamber comprises a conductive material.

3. The optical device according to claim 1, wherein the light-entrance end of the conductive chamber has a light source receiving hole configured to receive a light source.

4. The optical device according to claim 1, wherein the first optical module is a light focusing module.

5. The optical device according to claim 1, wherein any one of the second optical module and the third optical module comprises an optical element which allows a portion of a beam to pass through and reflects another portion of the beam.

6. The optical device according to claim 1, wherein the third optical module is a lens or a protective cover.

7. The optical device according to claim 1, wherein an edge of the first optical module, an edge of the second optical module, and an edge of the third optical module are all fixed on a sidewall of the conductive chamber.

8. The optical device according to claim 1, wherein materials of the first optical module, the second optical module, and the third optical module are glass or plastic.

9. The optical device according to claim 1, wherein a refractive index of a light transmitting medium in the first resonant space and the second resonant space is 1.

10. An illumination device comprising:

a light source adapted to output a beam; and an optical device disposed on a transmission path of the beam and comprising:

a conductive chamber having a light-entrance end, wherein the light source is disposed at the light-entrance end;

a first optical module fixed in the conductive chamber and adjacent to the light-entrance end; and a second optical module fixed in the conductive chamber, wherein the first optical module is located between the light-entrance end and the second optical module, and the conductive chamber, the first optical module, and the second optical module together define a first resonant space.

* * * * *